US005492136A

United States Patent [19]

Edmonds

[11] Patent Number: 5,492,136

[45] Date of Patent: Feb. 20, 1996

[54] EYELASH-CURLING APPARATUS

[76] Inventor: Elisa C. Edmonds, 3236 Lookout St., Mohegan Lake, N.Y. 10547

[21] Appl. No.: 153,571

[22] Filed: Nov. 17, 1993

[51] Int. Cl.[6] ..... A45D 40/26

[52] U.S. Cl. ..... 132/218; 132/112; 132/320

[58] Field of Search ..... 132/216, 217, 132/218, 320, 112

[56] References Cited

U.S. PATENT DOCUMENTS

| | | | |
|---|---|---|---|
| 2,196,235 | 4/1940 | Tuttle et al. | 132/216 |
| 4,056,111 | 11/1977 | Mantelet | 132/218 |
| 4,397,326 | 8/1983 | Formica | 132/218 |
| 4,428,388 | 1/1984 | Cassai et al. | 132/218 |
| 4,922,934 | 5/1990 | Gatti | 132/218 |
| 5,086,793 | 2/1992 | Kingsford | 132/218 |

*Primary Examiner*—John G. Weiss
*Attorney, Agent, or Firm*—Michael J. DeSha

[57] ABSTRACT

The apparatus for curling eyelashes comprises a handgrip which can be comforably held in the hand. A shaft is rotatably mounted on the handgrip and has a brush mounted on the shaft which is rotatable with the shaft using, for example, a thumbwheel attached to the shaft to enable the user to twirl the brush. As the brush engages and twirls the eyelashes, the lashes are groomed, curled and separated.

5 Claims, 2 Drawing Sheets

EYELASH-CURLING APPARATUS

FIELD OF THE INVENTION

The invention relates to cosmetic devices and more particularly to apparatus for curling eyelashes.

BACKGROUND OF THE INVENTION

Many significant aspects of a person's facial features are related to the appearance of the person's eyes. It is, of course, well known to apply mascara or other lash thickeners by way of a brush or the like and to curl or crimp the eyelashes by using a device having a scissor or squeezing action to squeeze the lashes into place to create an evenly-projecting curled array of lashes along each eyelid. Unfortunately, the pressure of the crimping or curling device as it squeezes the lashes can have a tendency to break some of the lashes which then can result in a thinning of eyelashes when the original object is to increase the thickness of the lashes in order to highlight the eyes. The device also does not provide the separation of the lashes which enhances the appearance of length of the lashes. The known device also is difficult to operate and requires great care to ensure the capture of the eyelashes within its crimping aperture.

SUMMARY OF THE INVENTION

It is therefore an object of the invention to provide an eyelash-curling device which overcomes the drawbacks of the known devices.

It is another object to provide an apparatus which can be easily and comfortably used for curling eyelashes.

Therefore, in accordance with the invention there is provided a holding means, a shaft rotatably mounted on said holding means, a plurality of bristles mounted at one end of the shaft, and means operably connected to the shaft for rotating the shaft on said holding means.

BRIEF DESCRIPTION OF THE DRAWING

The above set forth and other features of the invention are made more apparent in the ensuing Detailed Description of the Invention when read in conjunction with the attached Drawing, wherein.

DETAILED DESCRIPTION OF THE INVENTION

Figure 1:
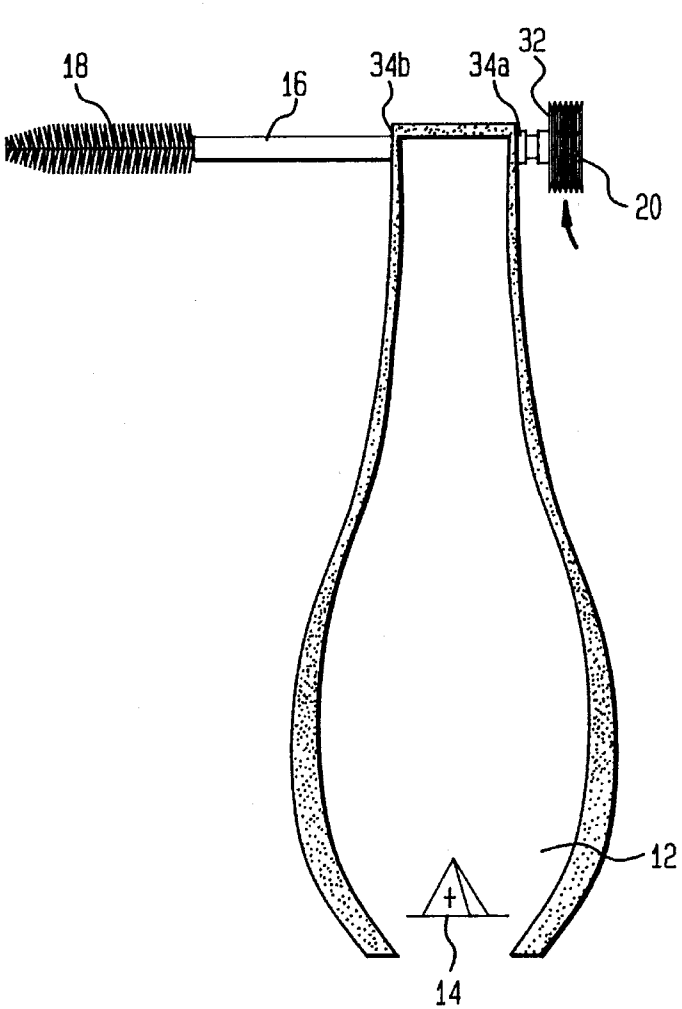
FIG. 1 shows a side view of an embodiment of the eyelash-curling apparatus in accordance with the invention.

FIG. 1 is a side view of an embodiment of the eyelash-curling device in accordance with the invention. Holder or handgrip 12 is suitably contoured to fit comfortably in the user's hand and is shown with a small opening at 14 which can be used for hanging the device if desired. The handgrip conveniently may be made of high impact plastic or of wood as desired.

Shaft 16 is rotatably mounted as illustrated in FIG. 1 at the upper end of the .handgrip, suitably through a borehole not seen in FIG. 1 in which the shaft is journalled. At one end of the shaft 16 there is affixed brush 18. For best results, the brush comprises gentle, buffer-like bristles. The brush may be similar to the brushes that are used for application of mascara. Other similar types of bristles may be used so long as the bristles are gentle and yet stiff enough to separate the eyelashes as the shaft is rotated. It will also be understood that the bristles may be affixed directly to the shaft if desired. Preferably, the bristles of the brush are shaped such that the shape of the brush fits the contour of the eye.

Knob or thumbwheel 20 is affixed to the other end of the shaft 16 to enable the user to rotate the shaft using the thumb or other finger for the purpose. It will be understood that other shapes of knob or thumbwheel may be used if desired and may be connected by way of gears or other motion-transmitting devices as necessary or desired.

Figure 2:
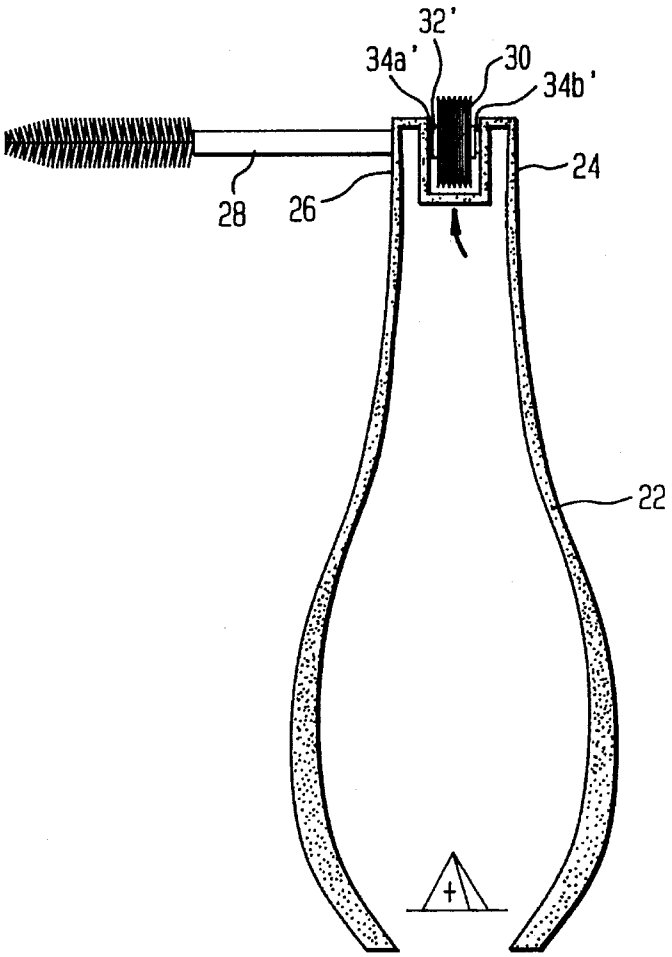
FIG. 2 illustrates another embodiment of a device in accordance with the invention.

FIG. 2 shows an alternate arrangement of the thumbwheel. In this embodiment, the handgrip 22 has two projecting lugs or ears 24 and 26 having bores therein (not shown) in which shaft 28 is journalled. Thumbwheel 30 in this case is mounted on the shaft 28 in between the two ears. It will be understood that in each of the embodiments illustrated, the wheels or mounted on and the shafts are prevented from slipping from position on the handgrip by means of collars and/or pins as illustrated, for example, at 32 and 34*a* and 34*b* in FIG. 1 and at 32' and 34*a'* and 34*b'* of FIG. 2, as is well known in the art.

Figure 3:
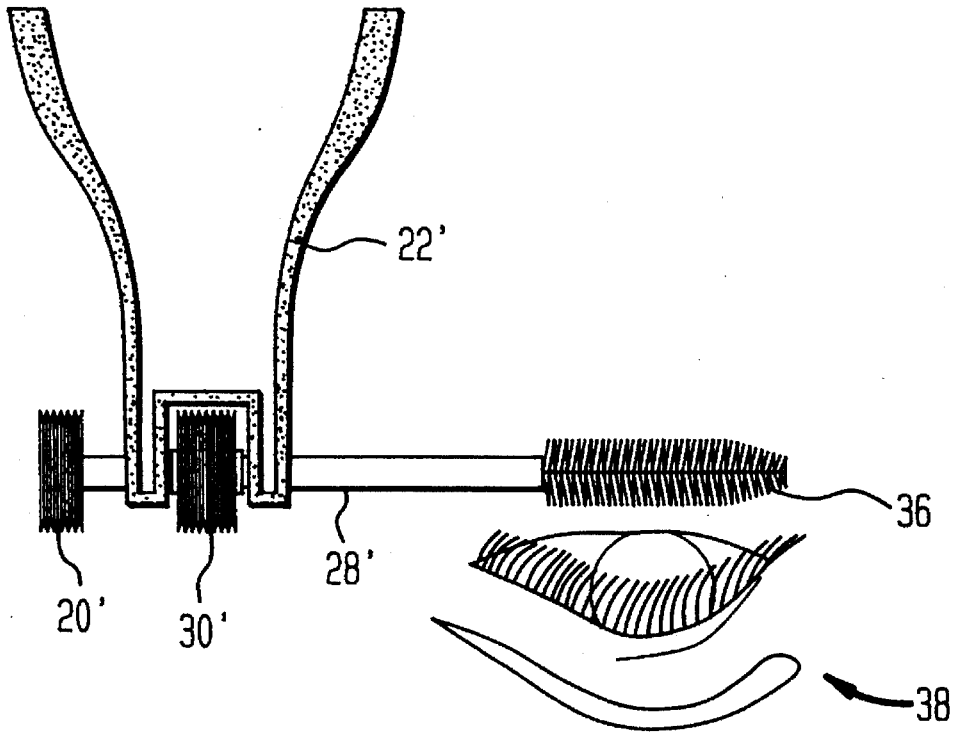
FIG. 3 shows another embodiment of the apparatus in position for operation.

FIG. 3 illustrates an embodiment in which thumbwheel 20' and thumbwheel 30' are both mounted on the shaft 28' of holder or handgrip 22'. The brush is shown juxtaposed in operative position next to the eyelashes 36 of a human eye shown generally at 38.

For operation, the brush of any embodiment of the illustrated device is brought into position as shown in FIG. 3 and the brush is twirled by rotation of the thumbwheel using the thumb or other finger. Each set of lashes on the eye may be treated in similar fashion. It will be understood from the foregoing that the apparatus in accordance with the invention may be used before or after the application of mascara or the like and may even be used for application of mascara if desired.

It will be appreciated from the foregoing that in accordance with the invention, the circular motion of the brush as it engages the eyelashes will groom, curl and separate the lashes to achieve the desired elongated look of the lashes. It will also be appreciated further that the curler in accordance with the invention provides easier and greater comfortability of handling than the previously known devices.

Having thus described my invention, what I claim as new, and desire to secure by Letters Patent is:

1. Apparatus for curling eyelashes comprising a holding means, a shaft rotatably mounted on said holding means, the holding means having at least two projecting lugs operative to receive the shaft for rotation thereof, said shaft having a portion extending outwardly from the holding means, a plurality of bristles mounted on the outwardly extending portion of the shaft, and thumbwheel means mounted on the shaft between the two lugs for rotating the shaft on said holding means.

2. The apparatus of claim 1 wherein the plurality of bristles comprise a brush mounted as an extension of the shaft.

3. Apparatus for curling eyelashes comprising a handgrip, a shaft rotatably mounted on said handgrip, a brush mounted on the shaft as an extension thereof and rotatable therewith, and thumbwheel means connected to the shaft for rotating the shaft on said handgrip.

4. The apparatus of claim 3 wherein the thumbwheel is mounted near one end of the shaft.

5. The apparatus of claim 3 wherein the handgrip has at least two projecting lugs operative to receive the shaft for rotation thereof and the thumbwheel is mounted on the shaft between the two lugs.

* * * * *